United States Patent [19]

Jordan-Ross

[11] Patent Number: 4,916,758

[45] Date of Patent: Apr. 17, 1990

[54] DISPOSABLE FULL EAR PROTECTOR FOR BEAUTICIAN USE

[76] Inventor: Erma Jordan-Ross, 8370 Greensboro Dr., Apt. 401, McLean, Va. 22102

[21] Appl. No.: 214,537

[22] Filed: Jul. 1, 1988

[51] Int. Cl.[4] ..... A41D 21/00

[52] U.S. Cl. ..... 2/174; 2/209; 128/866; 132/212

[58] Field of Search ..... 2/174, 209, 198; 128/866, 867, 868; 132/212, 333

[56] References Cited

U.S. PATENT DOCUMENTS

| | | | |
|---|---|---|---|
| 1,368,895 | 2/1921 | Cenerini | 128/866 |
| 2,441,866 | 5/1948 | Cantor | 2/209 UX |
| 2,570,675 | 10/1951 | Morris | 2/174 X |
| 3,871,372 | 3/1975 | Bivins | 128/866 |
| 4,023,642 | 5/1977 | Korn | 2/209 X |
| 4,193,396 | 3/1980 | Wacker | 128/866 X |
| 4,660,229 | 4/1987 | Harris | 2/174 X |

*Primary Examiner*—Peter Nerbun

*Attorney, Agent, or Firm*—Low and Low

[57] ABSTRACT

There is disclosed a full ear protector for beautician use during applications of liquid treatments which may irritate or otherwise cause discomfort to the ear flesh or outer ear canal, wherein the ear canal is protected by a plug while a full ear cover surrounds the ear proper. Absorbent materials on the inside of the ear cover and associated in and with the plug ensure that no unwanted liquids may contact the ear to any significant extent.

11 Claims, 1 Drawing Sheet

DISPOSABLE FULL EAR PROTECTOR FOR BEAUTICIAN USE

BACKGROUND OF THE INVENTION

In the routine and everyday practice of hair and scalp care by beauticians or by individuals in their homes, the head and especially the hair on the head or the scalp thereof is subjected to frequent and necessary treatments of diverse liquids as shampoos, hair colorants, tints, or frostings, conditioners, medical preparations, and the like. The liquids may be the treating material itself, or as part of any given treatment, a hair or scalp wash or rinse may be necessary.

In connection with any of these, thorough treatment and application to the head of the liquid material in ample quantity inherently subjects the ears to flow or running of liquid thereover and into the ear.

While this is quite unavoidable, depending upon the chemical and thermal nature of the treating material and the sensitivity characteristics of the user's skin, and especially the relatively more delicate flesh within the cupped ear and the outer ear canal proper may become irritated as liquid courses thereover.

While certain prior patents deal with ear cover devices, as Sutton D-91,794, Swan 1,953,517, and Schurmeier 1,255,800, the same are not directed to the problem at hand as particularly embracing the hazard of ear irritation as distinct from mere wetting of the ear.

It it desirable, then, and indeed medically preferable in given circumstances to provide a simple and effective means for protecting the relative interior surfaces of a user's ears from unnecessary flushing and presence of diverse hair and scalp treating liquids, especially with a full ear protector capable of reliably precluding unwanted contact of treating liquid with ear flesh.

SUMMARY OF THE INVENTION

My invention embraces a simple, easily used full ear protector which may be readily utilized by beauticians or other trained personnel in connection with hair and scalp liquid treatments of all types which readily precludes excessive wetting, or indeed virtually any wetting of the ear cup or ear canal by colorants, chemicals and the like.

The same is inexpensively fabricated, thereby lending itself to single-service use in accordance with health and medical regulations in beauty shops or other treating establishments.

By the same token, the ear protector of the invention may be equally easily employed by the individual user at home and with like beneficial results.

The ear protector of the invention comprises a flexible web or sheet of relatively thin plastic material, preferably faced on the ear-contact side with a softer or cushioning web of fabric or soft paper, wherein the protector is of sufficient size to encompass the entire ear. The protector includes means, such as elastic straps, for releasably attaching the same to the ear so as to substantially enclose the same and be retained thereon as by the elastic means, thereby preventing ready access of liquids applied over or onto the head for draining down into the open ear.

Equally importantly, the protector includes means cooperatively associated therewith to insure that no unwanted fluids enter the more delicate area of the outer ear canal should the same drip or leak around the full ear protector. To this end, an ear plug of plastic or the like is attached to the ear cover as by a connecting cord, and is inserted into the ear before the cover is placed around and over the ear.

Further, the plug includes a hollow bore which is filled with absorbent material, as cotton or tissue, and further has an absorbent collar about the plug body, whereby the chances of contact of the outer ear canal with deleterious fluid is reduced to virtually nil.

The ear cover includes a weakened zone centrally thereof to which the plug connector is attached, whereby after liquid treatment operations are completed, the weakened cover portion may be torn away and the ear plug removed, while the ear cover is left on the ear during drying or styling operations, so as to be protected from the relative heat or further inadvertent liquid drippage, and facilitate hearing of the user.

BRIEF DESCRIPTION OF THE DRAWINGS

The invention will be better understood in connection with the accompanying drawings, in which.

DESCRIPTION OF THE PREFERRED EMBODIMENT

Figure 1:
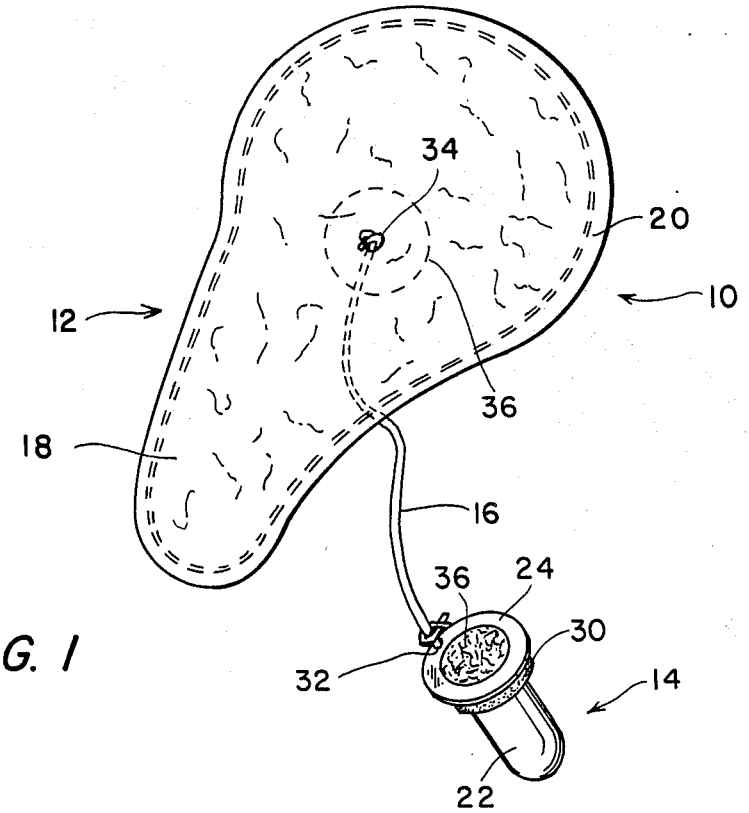
FIG. 1 is a perspective view of the ear protector including the outside face of the ear cover and the plug means attached thereto.
Figure 3:
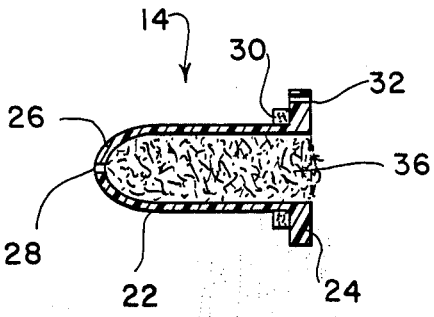
Figure 2:
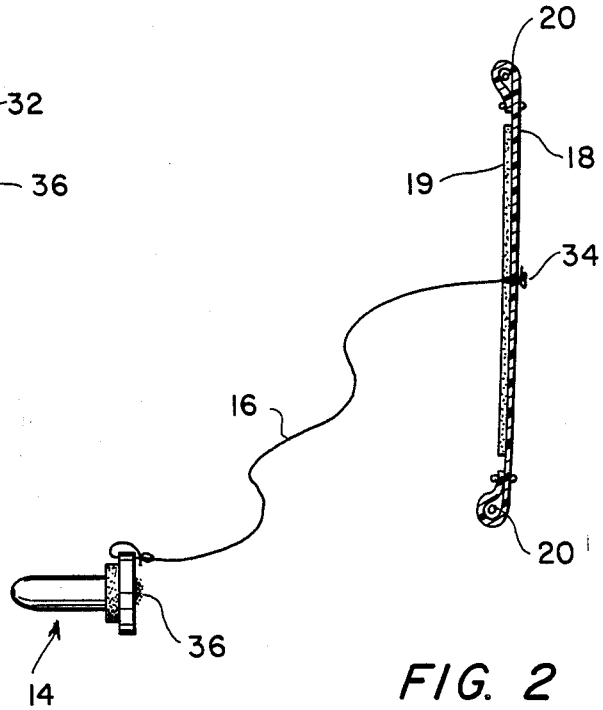
FIG. 2 is a side elevation, partly in section, of the device, showing one form of attachment means and cushion liner; and, FIG. 3 is an enlarged side sectional view of the plug.

Referring to the drawings, the ear protector 10 includes the ear cover 12, the ear plug 14, and the connector 16 therebetween, such as a cord or string.

The ear cover portion 12 of the protector may be readily fabricated from an inexpensive web of flexible plastic material 18, as polyethylene or like films, so as to be substantially waterproof or liquidproof as to ordinarily employed hair and scalp treating compositions, or at least water- or liquid-resistant with respect thereto. The web 18 is sized to embrace the likely range of human ears, or alternatively, such webs may be provided in several sizes as "Small", "Large", etc. for the convenience of the beautician or other user.

In order to relesably retain the ear cover upon the ear during head treatment applications, means are provided to grip the ear, as, illustratively, an elastic cord 20 disposed about the periphery of the ear cover and secured thereto in any convenient manner. As illustrated, cord 20 may be simply enfolded within a reversely turned portion of the outer cover 18, the edge of with is stitched or adhesively bonded to its adjacent face in known manner.

The inside face of outer ear cover web 18 is preferably provided with a soft lining of cotton or tissue 19 for greater comfort to the ear, although as the period of usage of the ear protector is not long, the provision thereof is not critical, depending upon the sensitivity of the user's ear or ears.

Uniquely associated with ear cover web 12 in protecting the ear is plug 14. The same is readily fabricated from plastic material and includes a tubular body 22 terminating at one end in a rounded nose 26 and at the other end in a peripheral flange 24 for ready manipulation. The nose 26 is apertured at 28 to communicate with the bore of body 22 so as to prevent excess pressures when applying it to or removing it from the ear. The bore of the plug is filled with absorbent material 38 as cotton or tissue, thereby further guaranteeing that no unwanted liquid that might seep past the ear web 18 could trickle into the outer ear canal through the plug bore. Further, and preferably, a cushioning washer 30 of soft material as cotton surrounds the body 22 adjacent flange 24 to further insure ear comfort and also to absorb any potential seepage around plug flange 24.

Flexible means, such as the length of cord 16 interconnect the ear web 12 and the plug 14 for ready unit handling thereof in packaging and use. The cord 16 is secured to plug 14 in any convenient manner, as by providing a hole 33 through flange 24 and knotting the cord therethrough. In like manner, the cord is affixed at 34 to ear cover 12 by suitable means, as adhesive, stapling, or knotting through an aperture therein.

Further, the ear web is weakened as by a circular series of minute perforations or reduced thickness zones 36 centrally of the web and about the connection 34 of the cord 16. This is for the purpose of easily removing the plug 14 from the ear while still leaving the ear cover 12 in place.

Optionally, the ear cover 12 and the plug 14 may be separately handled and unattached to each other, thereby eliminating cord 16. It is preferable to have the plug as a connected part so that its use will not be overlooked, with resultant possible irritation to the tender portions of the ear.

Accordingly, the ear protector of the invention including both the ear cover and the plug along with the connecting cord may be readily packaged in a sanitary manner, and provided if desired in one or more sizes for the convenience of the beautician or other user.

In use, the disposable full ear protector plug 14 is initially inserted into the ear by grasping the flange 24, after which the ear cover 12 is flexed and stretched against the light force of the retaining elastic means 20, and the cover slipped over the ear and comfortably positioned thereon.

Thereafter, usual and necessary hair or scalp treatments are effected with diverse solutions of soap and chemical nature, and the full ear protector including both the ear cover and the cooperating absorbent-filled plug prevent any significant contact of any treating liquid with the ear or ear canal. After the liquid treatments are completed, the central web section bounded by weakness lines 36 of the ear cover may be torn away with the cover on the ear, and the ear plug 14 removed so that conversation may be had while further beautician operations are performed as styling, blow drying, etc. In this connection, retention of the ear cover on the ear after plug removal ensures that the ear will not be subjected to unduly hot blasts of air in connection with drying operations.

What I claim is:

1. A full ear protector for beautician use and the like comprising, a web of flexible generally liquidproof material of sufficient area to cover a human ear for generally preventing unwanted liquid from entering the ear, said web having means for releasably attaching the same to the ear so as to substantially enclose the ear, ear plug means having a configuration for slidably fitting within the ear canal to prevent unwanted liquid from entering the ear canal, said ear plug means having a tubular configuration terminating at one end in a rounded tip for ready insertion into the ear and at the other end in an enlarged head for ready manipulation thereof and being formed from relatively rigid material, said ear plug means further including a central bore accessible from said enlarged head, and liquid absorbent material in said bore to assist in trapping any unwanted liquid within the web, and, means attaching said ear plug means to said ear cover web to provide a unit-handled assembly, whereby a user may initially insert the ear plug means into the ear canal and thereafter enclose the ear with said web in hair and scalp treatment operations.

2. The full ear protector of claim 1 wherein said web includes a lining of softer material on the side thereof in contact with the ear for comfort of the user.

3. The full ear protector of claim 1 wherein said plug means further includes an annular band of absorbent material around the plug means adjacent the head thereof to comfort the ear.

4. The full ear protector of claim 1 wherein said attaching means for said plug means and said ear cover is a flexible cord means extending between attachment points on said plug means and said ear web cover.

5. The full ear protector of claim 4 wherein said ear cover web is weakened adjacent its said cord attachment point to permit detachment of said cord therefrom and removal of said plug means without removal of said ear cover.

6. The full ear protector of claim 5 wherein said weakened ear cover defines a closed loop generally centrally thereof so as to be generally aligned with the ear and said plug means therein when said cover is in use.

7. The full ear protector of claim 2 wherein said ear cover is formed from flexible plastic.

8. The full ear protector of claim 1 wherein said means for releasably attaching said ear cover to the ear includes elastic band means disposed about the periphery thereof.

9. A full ear protector kit for beautician's use comprising, a web of flexible generally liquidproof material of sufficient area to cover a human ear for generally preventing unwanted liquid from entering the ear, said web having means for releasably attaching the same to the ear so as to substantially enclose the ear, said web further having a generally circular weakened area aligned with the ear canal when the ear cover is worn, ear plug means having a configuration for slidably fitting within the ear canal to prevent unwanted liquid from entering the ear canal, said plug means having a bore and absorbent material within said bore to assist in trapping any unwanted liquid, and whereby the said ear cover weakened area may be removed and access had through said ear cover to the said ear plug means in the ear of a wearer without requiring removal of the full ear cover.

10. The full ear protector kit of claim 9 further including a connecting cord means for respective attachment to said ear cover and said ear plug means.

11. The full ear protector kit of claim 9 further including an annulus of absorbent material surrounding said plug means.

* * * * *